US012571174B2

(12) United States Patent
Wilson

(10) Patent No.: US 12,571,174 B2
(45) Date of Patent: Mar. 10, 2026

(54) DEVICE AND METHOD FOR USE IN REPAIRING CABLE HIGHWAY GUARDRAILS

(71) Applicant: Zachary Wilson, Shelbyville, MI (US)

(72) Inventor: Zachary Wilson, Shelbyville, MI (US)

( * ) Notice: Subject to any disclaimer, the term of this patent is extended or adjusted under 35 U.S.C. 154(b) by 274 days.

(21) Appl. No.: 18/362,180

(22) Filed: Jul. 31, 2023

(65) Prior Publication Data

US 2024/0044093 A1 Feb. 8, 2024

Related U.S. Application Data

(60) Provisional application No. 63/394,377, filed on Aug. 2, 2022.

(51) Int. Cl.
*E01F 15/06* (2006.01)

(52) U.S. Cl.
CPC ..... *E01F 15/06* (2013.01)

(58) Field of Classification Search
CPC ... E01F 15/06; Y10T 24/3964; Y10T 24/3958
USPC ..... 24/135 L, 135 R; 254/119, 262, 199; 256/13.1
See application file for complete search history.

(56) References Cited

U.S. PATENT DOCUMENTS 356,869 A * 2/1887 De Haven ..... F16G 11/12 24/135 L
1,425,077 A * 8/1922 Choate ..... A01G 23/062 24/115 R
1,579,005 A 3/1926 Krout
1,604,109 A 10/1926 Anderson
1,699,772 A 1/1929 Wahlberg
1,710,243 A 4/1929 Rohrer
1,940,704 A * 12/1933 Sumpter ..... H01R 4/46 403/399
1,994,003 A 3/1935 Moore
2,061,371 A 11/1936 Taylor
2,070,550 A * 2/1937 Anthony ..... F16G 11/06 24/135 R
2,429,705 A 10/1947 Wadsworth
(Continued)

FOREIGN PATENT DOCUMENTS

GB 150905 A 9/1920
GB 351062 A 6/1931
WO WO-2004067851 A1 * 8/2004 ..... E01F 15/06

*Primary Examiner* — Brian E Glessner
(74) *Attorney, Agent, or Firm* — Price Heneveld LLP

(57) ABSTRACT

A cable tensioning assembly includes a body. The body defines a tensioner receiver configured to couple to a tensioning vehicle, a plurality of first mounting apertures and a plurality of second mounting apertures. The plurality of first and second mounting apertures cooperatively define a plurality of fastener receptacles. At least one channel with a textured surface is configured to receive a cable. A plurality of fasteners are included. Each fastener includes a first end and a second end that are received by the plurality of fastener receptacles. A friction force is applied to the cable by the fasteners and the channel. The engagement of the cable with the cable tensioning assembly is configured to adjust a tensioning force to the cable in response to movement of the tensioning vehicle. The cable tensioning assembly is configured to divide the cable into an adjustment section and a repair section.

10 Claims, 14 Drawing Sheets

(56) References Cited

U.S. PATENT DOCUMENTS

| | | | | |
|---|---|---|---|---|
| 2,944,788 | A * | 7/1960 | Schaefer | F16G 11/12<br>24/135 R |
| 2,946,108 | A | 7/1960 | Bethea | |
| 4,143,446 | A * | 3/1979 | Down | F16G 11/06<br>403/312 |
| 4,405,828 | A * | 9/1983 | Shook | H01B 17/56<br>24/135 R |
| 5,015,205 | A * | 5/1991 | Franks, Jr. | H01R 4/38<br>439/803 |
| 2013/0214226 | A1* | 8/2013 | Gamez | F16G 11/106<br>256/13.1 |

* cited by examiner

DEVICE AND METHOD FOR USE IN REPAIRING CABLE HIGHWAY GUARDRAILS

CROSS-REFERENCE TO RELATED APPLICATION

This application claims priority to and the benefit under 35 U.S.C. § 119(e) of U.S. Provisional Patent Application No. 63/394,377, filed on Aug. 2, 2022, entitled DEVICE AND METHOD FOR USE IN REPAIRING CABLE HIGHWAY GUARD RAILS, the entire disclosure of which is hereby incorporated herein by reference.

FIELD OF THE DISCLOSURE

The present disclosure generally relates to a cable tensioning assembly, and more particularly, to a cable tensioning assembly having a channel and a plurality of fasteners configured to hold a traffic-grade cable.

BACKGROUND OF THE DISCLOSURE

Roadways include various types and configurations of guardrails for preventing traffic from inadvertently crossing into lanes of oncoming traffic or for preventing traffic from leaving the roadway. One type of guardrail is a cable guardrail that uses a number of vertically spaced cables to create a barricade. When a vehicle collides with the cable guardrail, the cables typically break. When these cables are repaired, the cables need to be tensioned and returned to their original position.

SUMMARY OF THE DISCLOSURE

According to a first aspect of the present disclosure, a cable tensioning assembly includes a body. The body defines a tensioner receiver configured to couple to a tensioning vehicle, a plurality of mounting apertures, where the plurality of mounting apertures cooperatively define a plurality of fastener receptacles, at least one channel configured to receive a cable, where the at least one channel includes a textured surface, and a plurality of fasteners. Each fastener of the plurality of fasteners are received by the plurality of fastener receptacles. The cable is operatively coupled to the cable tensioning assembly via a friction force applied to the cable by at least the plurality of fasteners and the at least one channel. An engagement of the cable with the cable tensioning assembly is configured to adjust a tensioning force to the cable in response to movement of the tensioning vehicle. The cable tensioning assembly is configured to divide the cable into an adjustment section that temporarily experiences an increased tension and a repair section that temporarily experiences a decreased tension.

According to another aspect of the present disclosure, a cable tensioning assembly includes a body. A body includes a tensioner receiver that is configured to couple the cable tensioning assembly to a tensioning vehicle, a plurality of mounting apertures, a plurality of fasteners, where the plurality of fasteners interacts with the plurality of mounting apertures, at least one channel is configured to receive a cable to be repaired, where the at least one channel includes a textured surface, and a plurality of plates. Each plate of the plurality of plates includes an opposing textured surface and a plurality of openings to cooperate with the plurality of mounting apertures of the body. The plurality of mounting apertures and the plurality of openings of the plurality of plates are configured to receive the plurality of fasteners to secure the cable within the at least one channel of the body in a friction fit. The cable tensioning assembly is configured to divide the cable into an adjustment section extending between the tensioning vehicle and a fixed end and a repair section extending between the tensioning vehicle and a free end. An engagement of the cable with the cable tensioning assembly is configured to adjust a tensioning force to the cable in response to movement of the tensioning vehicle.

According to yet another aspect, a method for tensioning a cable includes aligning the cable with a channel defined on a cable tensioning assembly, placing a plurality of fasteners around the cable, inserting the plurality of fasteners into respective mounting apertures defined on the cable tensioning assembly, tightening the plurality of fasteners with the cable tensioning assembly to apply a retaining friction force to the cable, coupling the cable tensioning assembly to a tensioning vehicle via a tensioning receiver defined on the cable tensioning assembly, operating the tensioning vehicle to increase a first magnitude of tension along an adjustment section of the cable between a fixed end of the cable and a portion of the cable coupled with the cable tensioning assembly, securing a free end of the cable to a directed location to create a second magnitude of tension along a repair section of the cable between the free end of the cable and the portion of the cable coupled with the cable tensioning assembly, operating the tensioning vehicle toward equalizing the first magnitude of tension with the second magnitude of tension, and decoupling the cable tensioning assembly from the cable.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
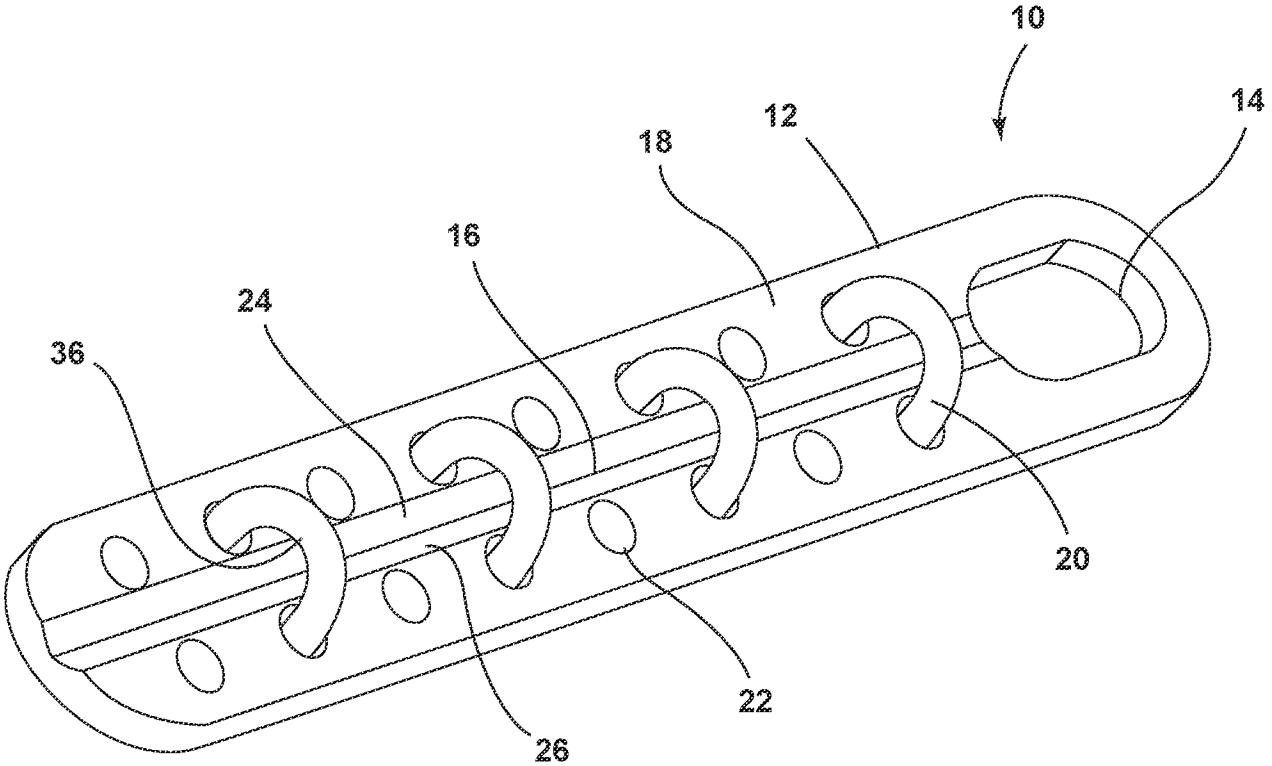
FIG. 1 is a side perspective view of a cable tensioning assembly free of a cable.
Figure 2:
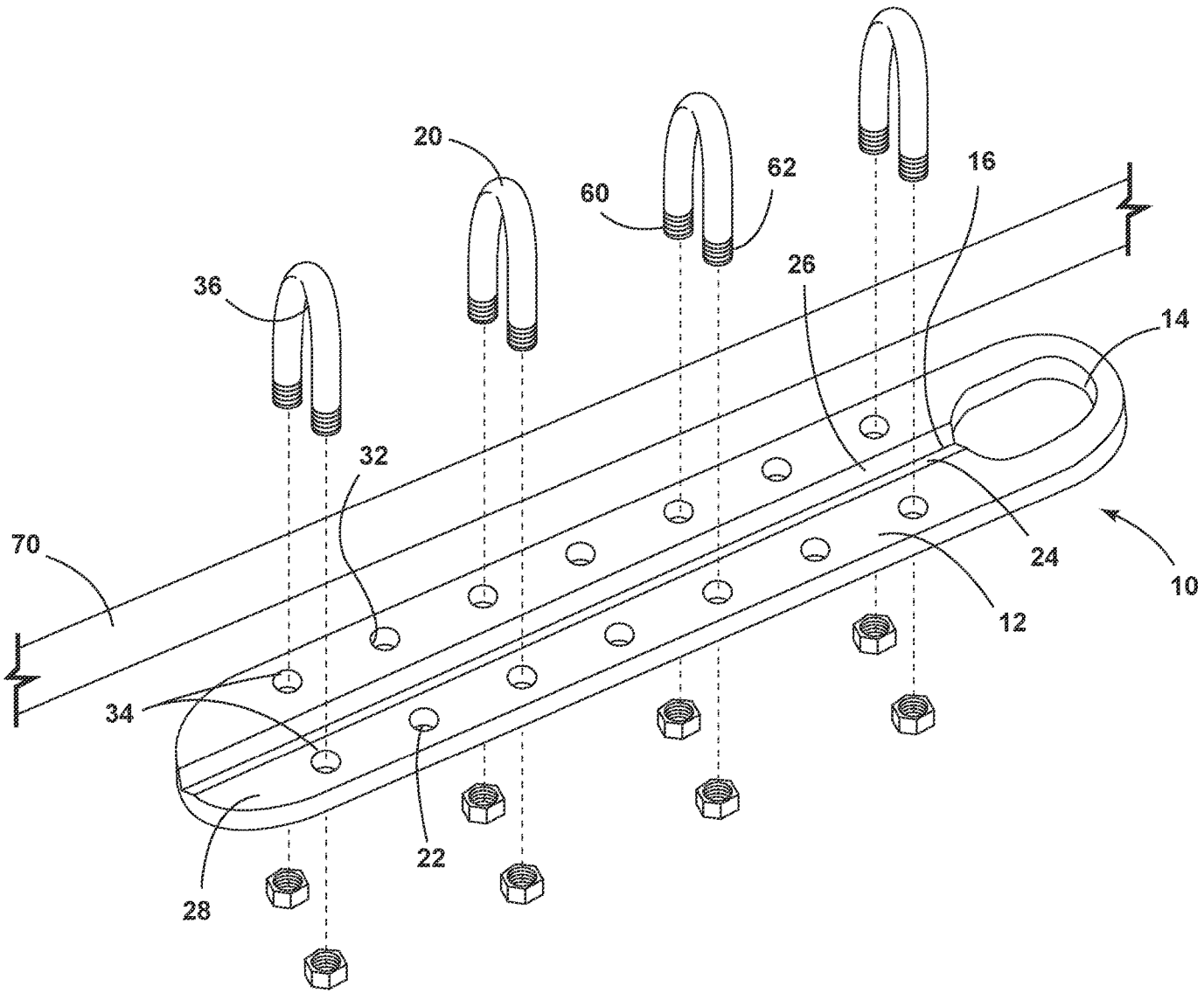
FIG. 2 is an exploded perspective view of the cable tensioning assembly including a cable.
Figure 3:
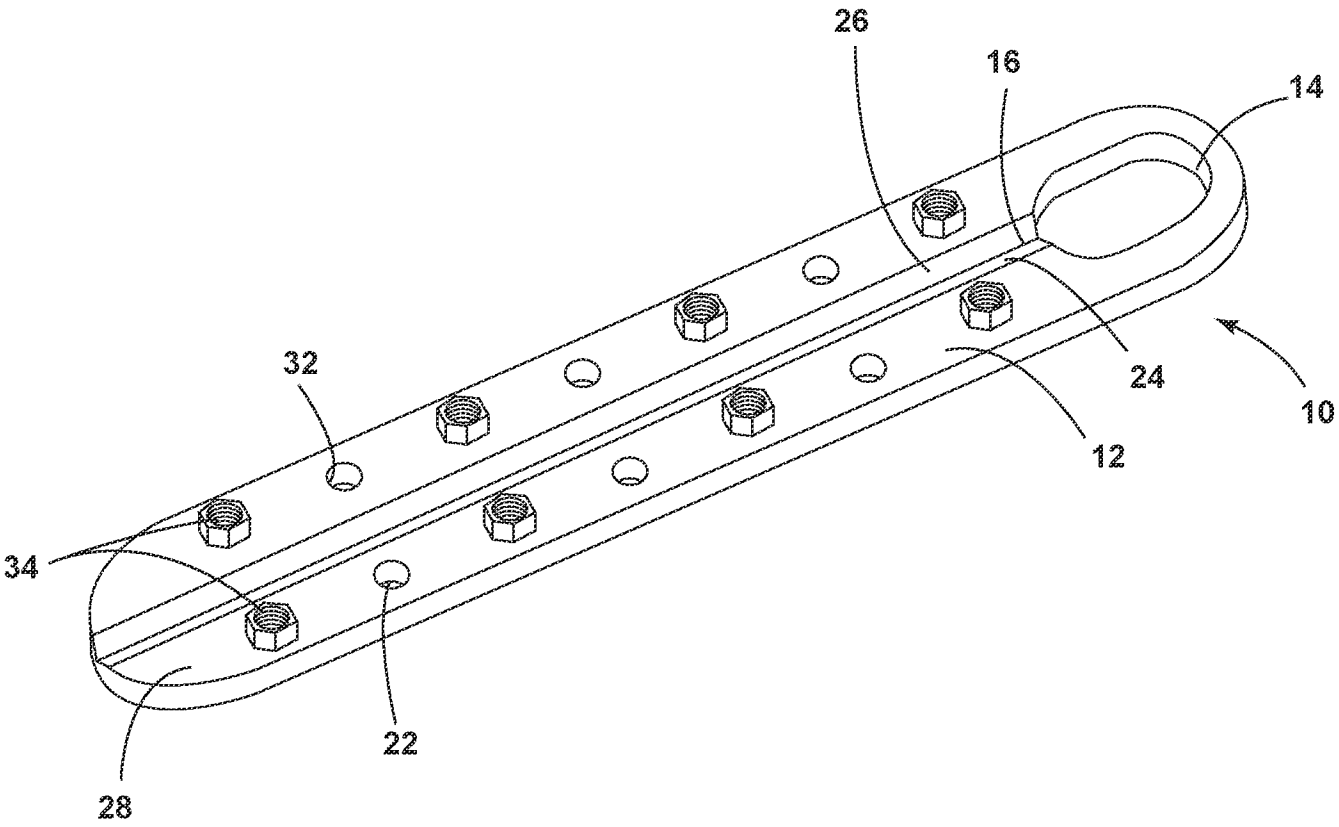
FIG. 3 is another side perspective view of the cable tensioning assembly.
Figure 4:
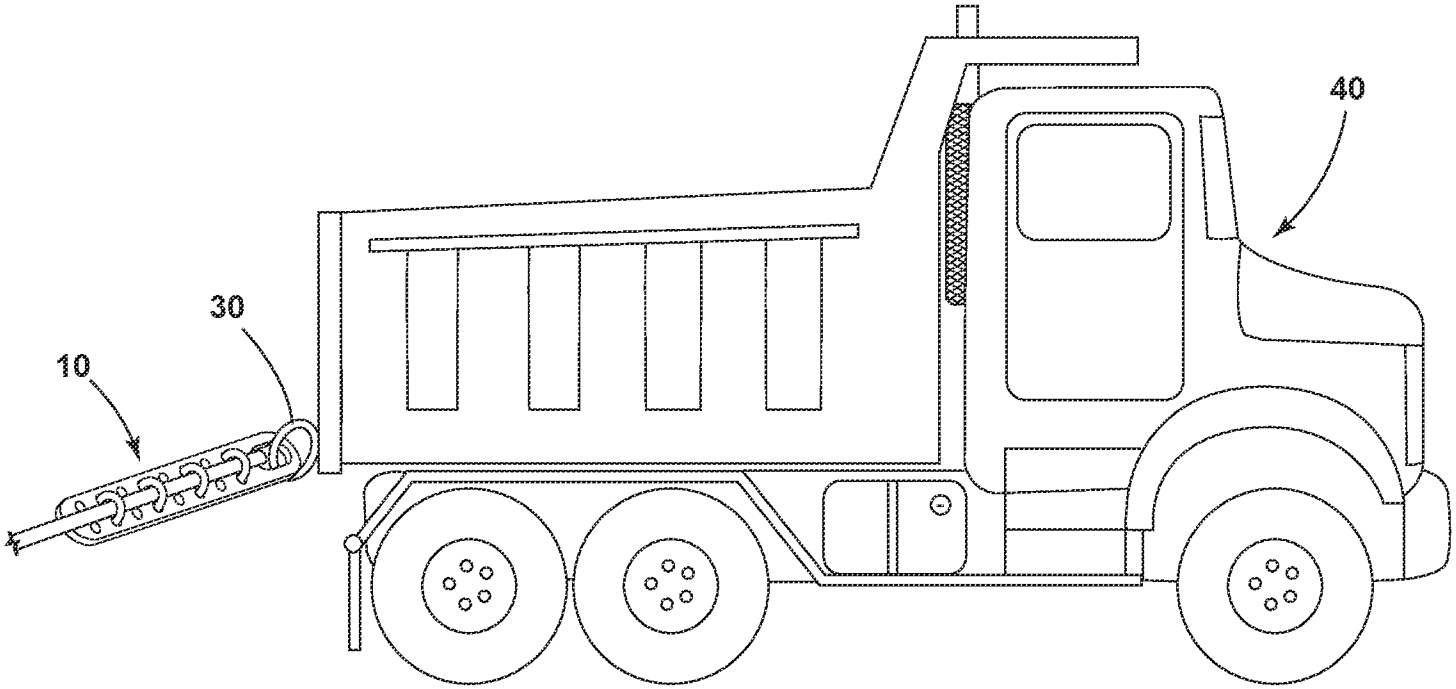
FIG. 4 is a schematic side elevation view of the cable tensioning assembly mounted on an exemplary tensioning vehicle.

Reference will now be made in detail to the present preferred embodiments of the disclosure, examples of which are illustrated in the accompanying drawings. Wherever possible, the same reference numerals will be used throughout the drawings to refer to the same or like parts. In the drawings, the depicted structural elements are not to scale and certain components are enlarged relative to the other components for purposes of emphasis and understanding.

As required, detailed embodiments of the present disclosure are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a cable tensioning assembly for repairing cables of a cable guardrail. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIGS. 1-5E, a cable tensioning assembly 10 comprises a body 12. Typically, the body 12 includes a single portion. The body 12 comprises a top surface 18 and a bottom surface 28. The body 12 includes a tensioner receiver 14 that includes an aperture that receives a coupling device 30. The tensioner receiver 14 couples with a tensioning vehicle 40 directly or through an intermediary attachment. The tensioning vehicle 40 is typically a vehicle used in traffic control devices (e.g., a dump truck, a snow plow truck, or other similar road commission vehicle). The cable tensioning assembly 10 typically couples with a rear side of the tensioning vehicle 40, as shown in FIGS. 4, 5C, 5D, and 5E. Additionally, or alternatively, the cable tensioning assembly 10 may couple with the tensioning vehicle 40 on various locations of the tensioning vehicle 40 (e.g., a lateral side, a front side, etc.). The body 12 includes a plurality of first mounting apertures 22 and a plurality of second mounting apertures 32. The plurality of first and second mounting apertures 22, 32 cooperatively define a plurality of fastener receptacles 34. The plurality of first mounting apertures 22 are generally aligned with and parallel to the plurality of second mounting apertures 32, along a length of the body 12. The body 12 also includes a channel 16 that extends along the body 12 from the tensioner receiver 14 and along the remaining length of the body 12. The plurality of first mounting apertures 22 are opposed, and typically diametrically opposed, from the plurality of second mounting apertures 32, wherein the channel 16 extends therebetween.

Additionally, or alternatively, the plurality of first and second mounting apertures 22, 32 may be located within the channel 16. It is also contemplated that the body 12 can include at least one channel 16 on at least one of the top surface 18 and the bottom surface 28. Additionally, or alternatively, the body 12 may extend along a plurality of portions including at least a first portion, a sloped portion, and a second portion. In certain aspects of the device, the second portion of the body 12 is offset from the first portion of the body 12 by the sloped portion of the body 12. The tensioner receiver 14 is defined within the first portion of the body 12. The plurality of first and second mounting apertures 22, 32 and the at least one channel 16 are defined within the second portion of the body 12. Where the sloped portion is utilized, the sloped portion places the first portion and the second portion of the body 12 along different generally parallel planes. This offset configuration allows the cable 70 to extend across the body 12 without interfering with the tensioner receiver 14 or the connection of the tensioner receiver 14 with the tensioning vehicle 40. In certain aspects of the device, the sloped portion can be absent such that that the body 12 extends along a single flat member, typically made of steel or an alloy thereof.

Figure 9:
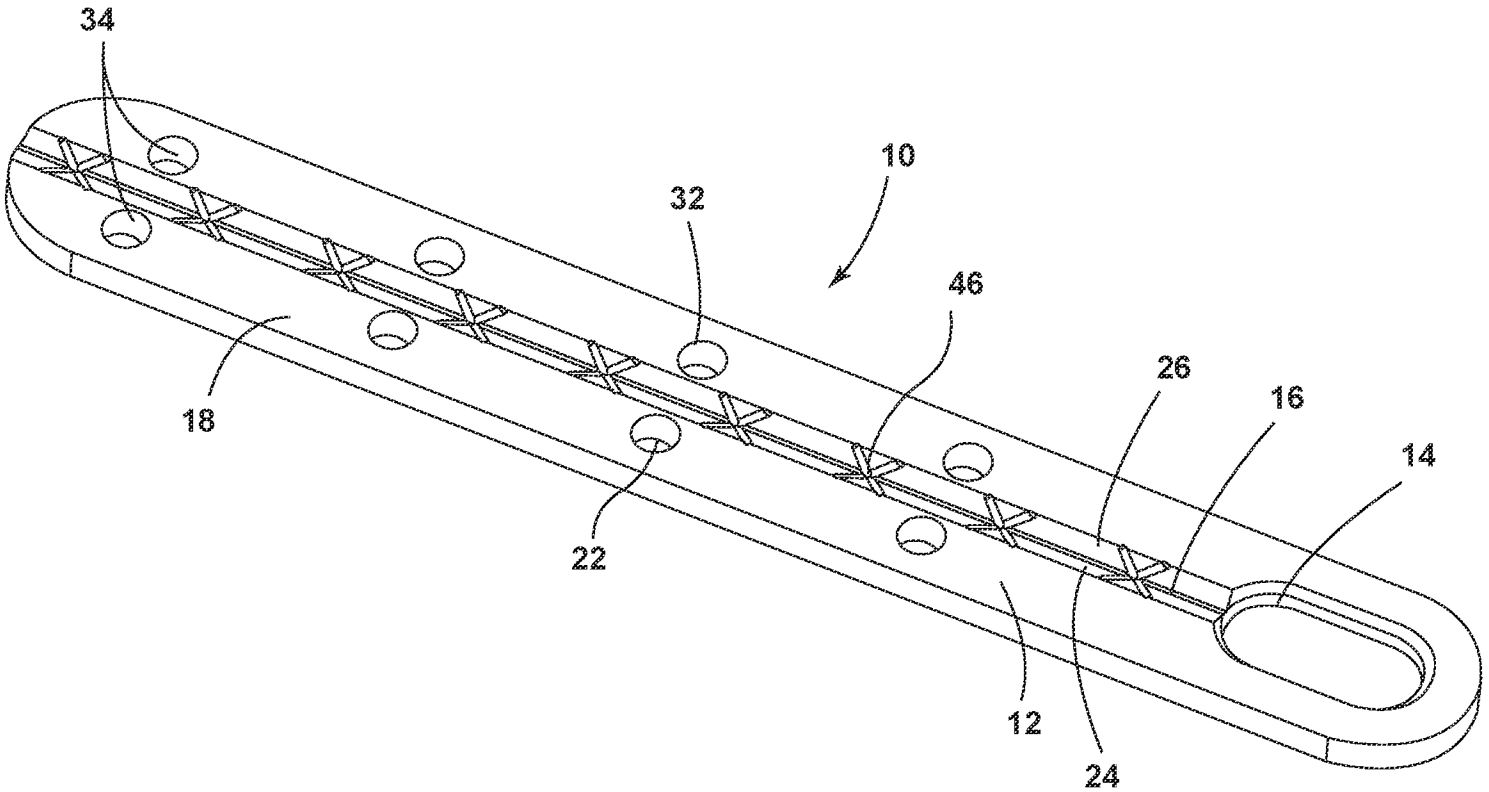
FIG. 9 is a side perspective view of a cable tensioning assembly free of a cable and free of a fastener.
Figure 10:
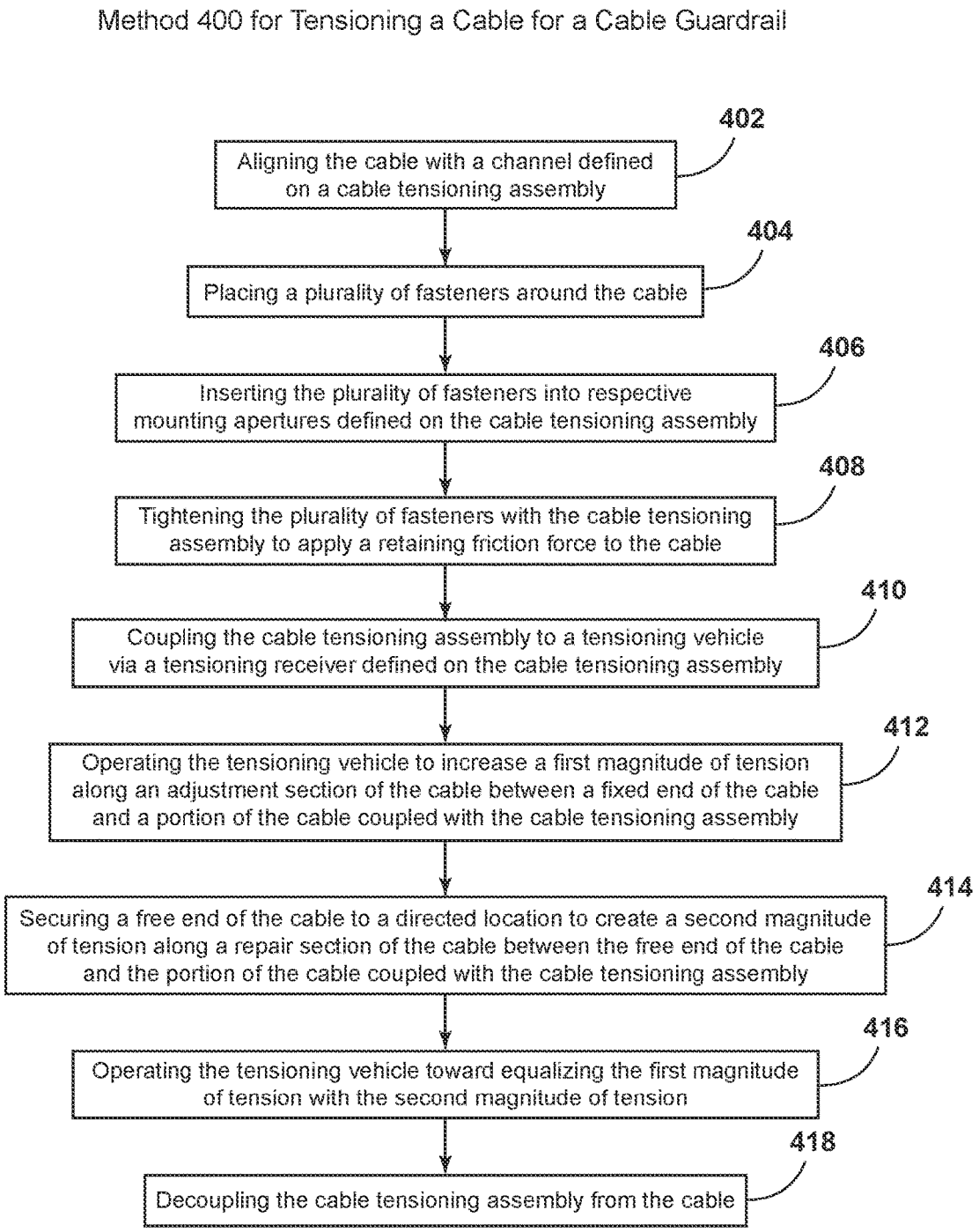
FIG. 10 is a linear flow diagram of a method for tensioning a cable for a cable guardrail.

To assist in holding a cable 70 within the cable tensioning assembly 10, the channel 16 typically includes a first textured surface 24. In addition, the channel 16 can be generally V-shaped, such that the channel 16 includes a second textured surface 26 that opposes the first textured surface 24. The channel 16 may also include a plurality of engravings 46, as shown in FIG. 9. The cable tensioning assembly 10 includes a plurality of fasteners 20. It is contemplated the plurality of fasteners 20 include a first end 60 and a second end 62 that are received by the plurality of fastener receptacles 34. The channel 16 can include other cross-sectional shapes that includes at least one of the first and second textured surfaces 24, 26 that at least partially surround or encircle a portion of the cable 70 that is within the cable tensioning assembly 10.

According to the various aspects of the device, the cable guardrail that includes a plurality of cables 70 can be damaged, such as during a vehicle collision that involves the guardrail. In these conditions, one or more of the cables 70 typically breaks in a central section of the cable 70 between a fixed end 76 and a secured end 78. When a cable 70 breaks or is severed, the cable 70 requires repair, and the free end 78 of the cable 70, using the cable tensioning assembly 10, is placed in an un-tensioned state. In this un-tensioned state, workers can conveniently repair a section of the cable 70 that is generally slack or completely slack.

Figure 6:
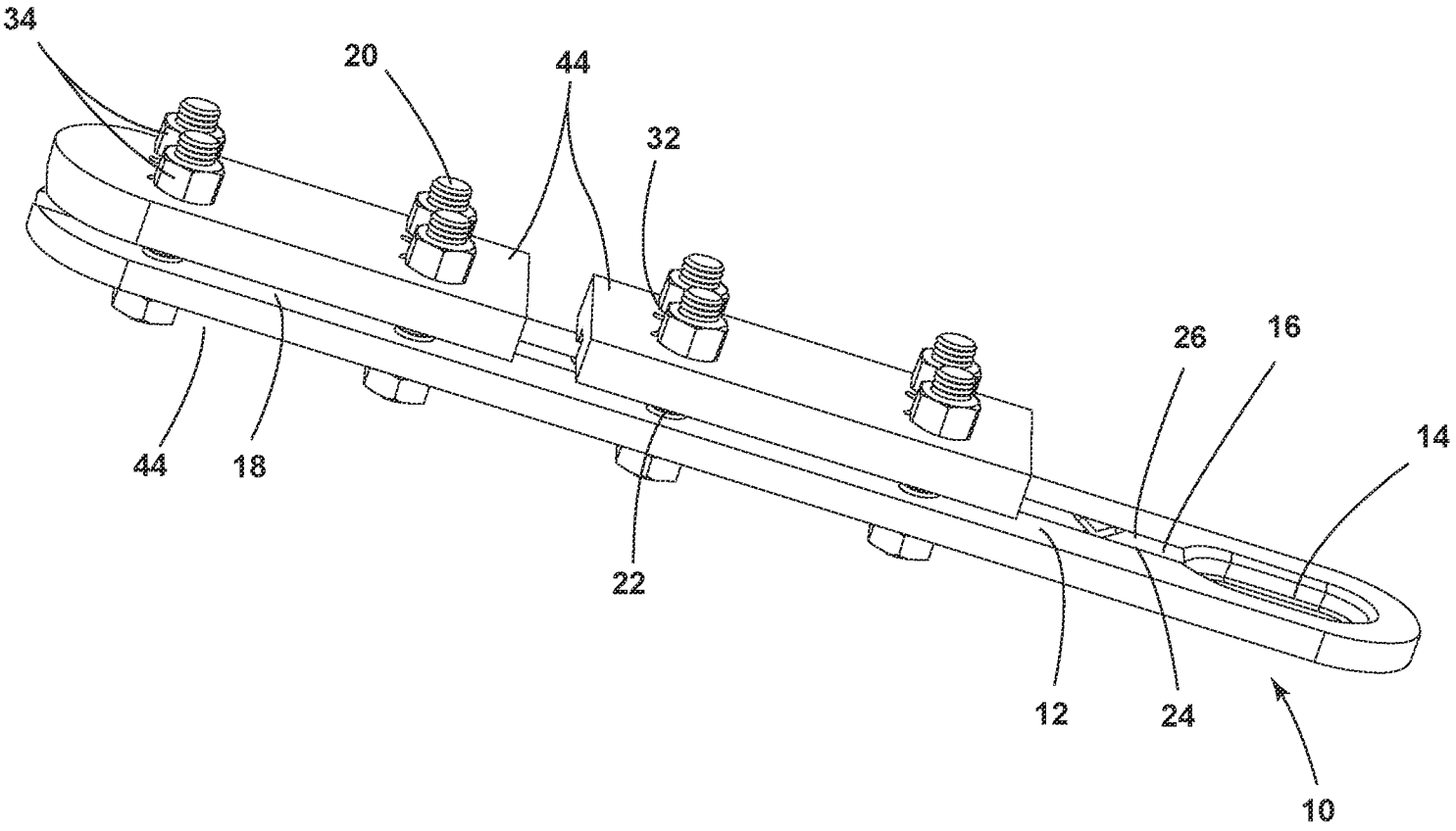
FIG. 6 is a side perspective view of a cable tensioning assembly free of a cable.
Figure 7:
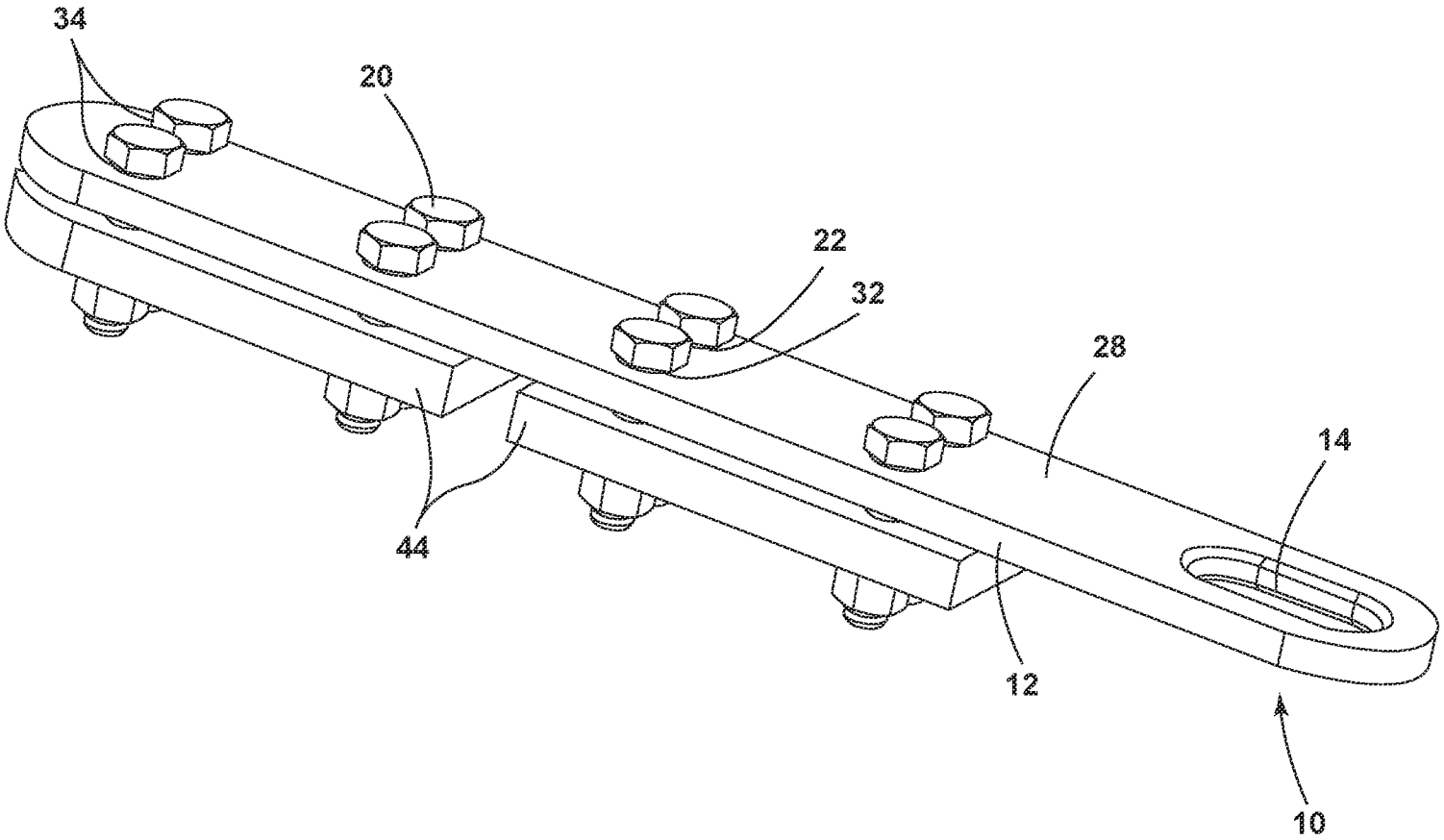
FIG. 7 is another side perspective view of a cable tensioning assembly free of a cable.
Figure 8:
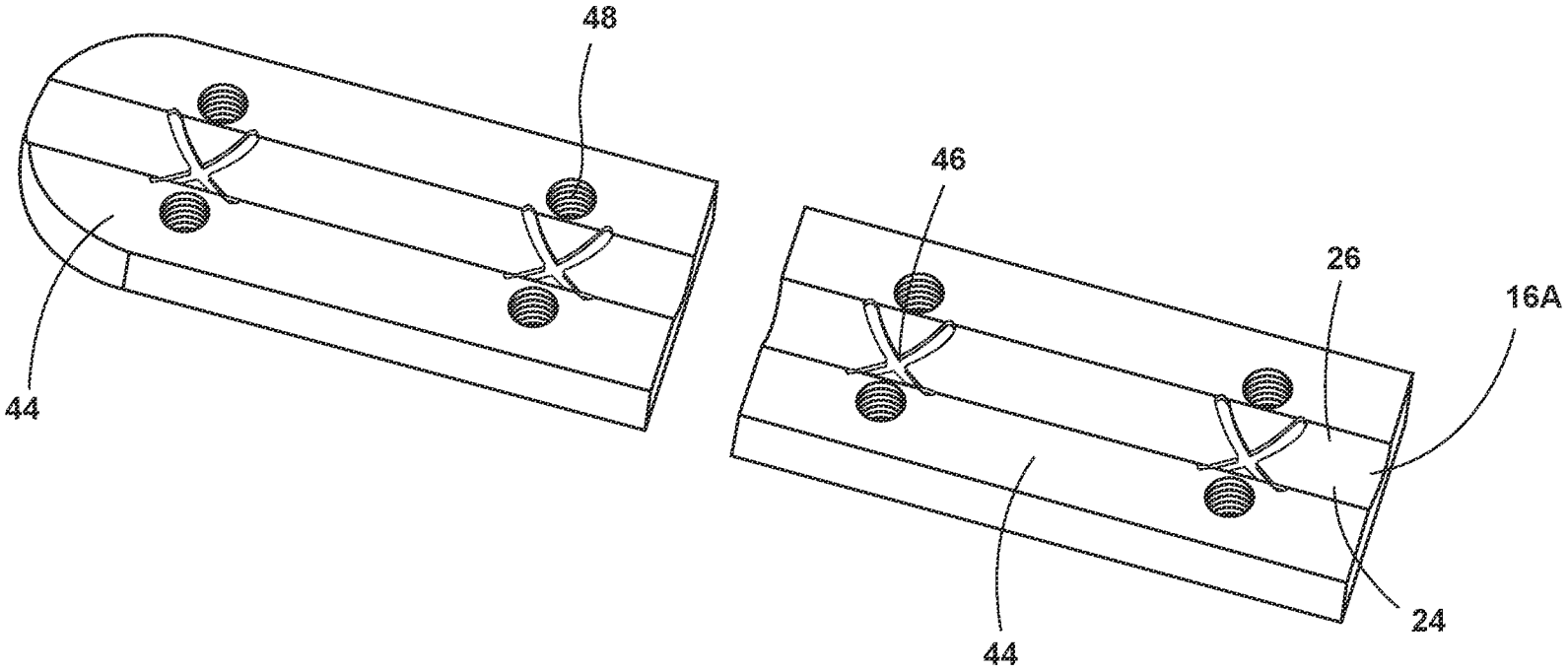
FIG. 8 is a side perspective view of two plates used in connection with the cable tensioning assembly of FIG. 6.

In reference to FIGS. 6-8, the cable tensioning assembly 10 may include one or more plates 44. The plates 44 include a plurality of openings 48 that cooperate with the first mounting apertures 22 and the second mounting apertures 32 of the body 12. The plurality of first and second mounting apertures 22, 32 and the openings 48 of the one or more plates 44 are configured to receive, or otherwise interact with, the plurality of fasteners 20. Using the fasteners 20, a plurality of plates 44 are biased against the body 12 to secure, attach, or otherwise engage the cable 70 within the channel 16 of the body 12 in a friction fit. The one or more plates 44 can each include an opposing channel 16A that is positioned opposite the channel 16 of the body 12. With the cable 70 positioned in the cable tensioning assembly 10, the channel 16 and the opposing channel 16A of the one or more plates 44 can form a friction interface that cooperates to engage and encircle a friction portion of the cable 70 to generate the friction fit. While the cable 70 is held by the cable tensioning assembly 10, the channel 16 of the body 12 and the opposing channel 16A of the one or more plates 44 applies a compressive force to the friction portion of the cable 70 to define the friction fit. Using this generated friction fit, the friction forces are distributed across the friction portion of the cable 70. The distribution of the friction forces preserves the cable 70 and diminishes the likelihood of damage to the cable 70 and also makes the engagement between the friction interface of the cable tensioning assembly 10 and the friction portion of the cable 70 more secure. The opposing channel 16A of the one or more plates 44 may include a first textured surface 24, a second textured surface 26, and/or a plurality of engravings 46. In use, the plurality of plates 44 can be used to spread the compressive force applied by the fasteners 20 over a significant surface area of the cable 70. This can be used to form a high magnitude friction fit without damaging the cable 70. This increased friction-generating surface area provided by the plurality of plates 44 prevents slippage of the cable 70 with respect to the cable tensioning assembly 10.

To accommodate the rounded shape of the cable 70, it is contemplated that the plurality of fasteners 20 are arcuate, such as U-bolts, wherein an underside 36 of the plurality of fasteners 20 may be textured in a manner similar to the texture of the channel 16, as shown in FIGS. 1, 2, 4, 5B, 5C, 5D, and 5E. Additionally, or alternatively, the fasteners 20 of the cable tensioning assembly 10 may include one or more plates 44, as shown in FIGS. 6-8. Each of the plates 44 can include the opposing channel 16A or a textured surface to form the friction fit of the cable tensioning assembly 10. The plurality of fasteners 20 are inserted into the plurality of fastener receptacles 34 to define a friction interface through which the cable 70 is disposed. Using this friction interface, a friction fit is formed between the plurality of fasteners 20 and the channel 16, and a cable 70 extending therethrough. This friction fit secures the cable 70 within the cable tensioning assembly 10 without substantially deforming or compressing the cable 70 that may otherwise compromise the individual strands that make up the cable 70. The friction fit divides the cable 70 into two sections: an adjustment section 72 that extends from the fixed end 76 to the cable tensioning assembly 10, and a repair section 74 that extends from the cable tensioning assembly 10 to the free end 78, also referred to herein as the secured end 78, which opposes the fixed end 76.

In certain applications, the cables 70 that are received within the cable tensioning assembly 10 can be used in traffic control devices. Such devices are typically in the form of high-tension cable guardrails. When these types of guardrails become damaged, and require repair, it is useful to manipulate the tension experienced within certain portions of the cable 70. By way of example and not limitation, it is useful to temporarily decrease, diminish, or even eliminate the tension on the cable 70 in areas where the cable 70 is being worked on. This temporary decrease of tension makes the cable 70 more easily manipulated and repaired by work crews. Necessarily, this requires a corresponding temporary increase in the tension experienced by the cable 70 in other areas. Using the cable tensioning assembly 10 and a tensioning vehicle 40, as is described herein, a broken or otherwise damaged cable 70 can be repaired and reattached to repair the guardrail for a particular roadway. It is also contemplated that the cable tensioning assembly 10 can be used for installing a new guardrail that is made from cables 70, as well as for replacing a used cable 70.

In further reference to FIGS. 1-5E, use of the cable tensioning assembly 10 may begin with placing the cable 70 that is in need of repair within the channel 16. Typically, the cable 70 is also disconnected from a secured end 78, then the cable 70 is repaired (e.g., the attachment of a turn buckle, welding, or other similar cable repairment). The tensioner receiver 14 is directed toward one of a free end 78 of the cable 70 and a fixed end 76 of the cable 70. The plurality of fasteners 20 are inserted into the plurality of fastener receptacles 34 over the cable 70, typically the first end 60 and second end 62 of each fastener 20 are respectively inserted into the first mounting aperture 22 and the second mounting aperture 32. The plurality of fasteners 20 are then secured to the body 12 (e.g., threaded lug nuts, tongue-serration relationships, pins, etc.). The cable 70 is then between the underside 36 of the plurality of fasteners 20 and the channel 16. It is contemplated that each fastener 20 of the plurality of fasteners 20 has a textured underside 36 that is further inserted into each fastener receptacle 34 of the plurality of fastener receptacles 34 to define a friction interface between the channel 16, the plurality of fasteners 20, and the cable 70, which forms a friction fit.

After the friction fit of the cable tensioning assembly 10 and the cable 70 is defined, the cable 70 has two sections: an adjustment section 72 that extends between the cable tensioning assembly 10 and the fixed end 76 of the cable 70; and a repair section 74 that extends between the cable tensioning assembly 10 and a free end 78 of the cable 70. The tensioner receiver 14 of the cable tensioning assembly 10 is then operably coupled with the tensioning vehicle 40 directly in order to adjust tension of the cable 70. The tensioner receiver 14 of the cable tensioning assembly 10 operably couples with the tensioning vehicle 40 via a coupling device 30 (e.g., an outrigger, a carabineer, a hook, or another coupling device known by one skilled in the art).

Once the cable tensioning assembly 10 is secured to the tensioning vehicle 40, the tensioning vehicle 40 moves in a direction away from the fixed end 76. This movement operates to increase a first magnitude of tension in the adjustment section 72 of the cable 70, typically by driving forward and toward the free end 78 of the cable 70. In response to the movement of the of the tensioning vehicle 40 away from the fixed end 76, there is a resulting increase in the tension experienced by the adjustment section 72. This movement of the tensioning vehicle also provides slack to the repair section 74 to allow workers more convenient conditions under which the cable 70 can be re-tensioned. Using the additional slack, the free end 78 of the cable 70 is then secured to oppose the fixed end 76 of the cable 70. Because of the increased tension in the adjustment section 72, the repair section 74 is under little tension or no tension as the free end 78 of the cable 70 is secured to the secured end 78. This attachment typically defines a second magnitude of tension in the repair section 74 that is significantly less than the first magnitude of tension that is exerted on the adjustment section 72 between the fixed end 76 and the tensioning vehicle 40.

The tensioning vehicle 40 then operates toward the fixed end 76. This movement of the tensioning vehicle 40 toward the fixed end 76 defines an equalized tension between both the adjustment section 72 of the cable 70 and the repair section 74 of the cable 70, which is now attached between the fixed end 76 and the secured end 78. Typically, this is done by reversing the tensioning vehicle 40 to operate toward the fixed end 76. It is contemplated that if the adjustment section 72 of the cable 70 is not extending in a similar direction as the repair section 74 of the cable 70, then the tensioning vehicle 40 operates toward equalizing the tension experienced by the adjustment section 72 of the cable 70 and the repair section 74 of the cable 70. The cable tensioning assembly 10 is then decoupled from the cable 70, and the cable tensioning assembly 10 is also decoupled from the tensioning vehicle 40.

Figure 5A:
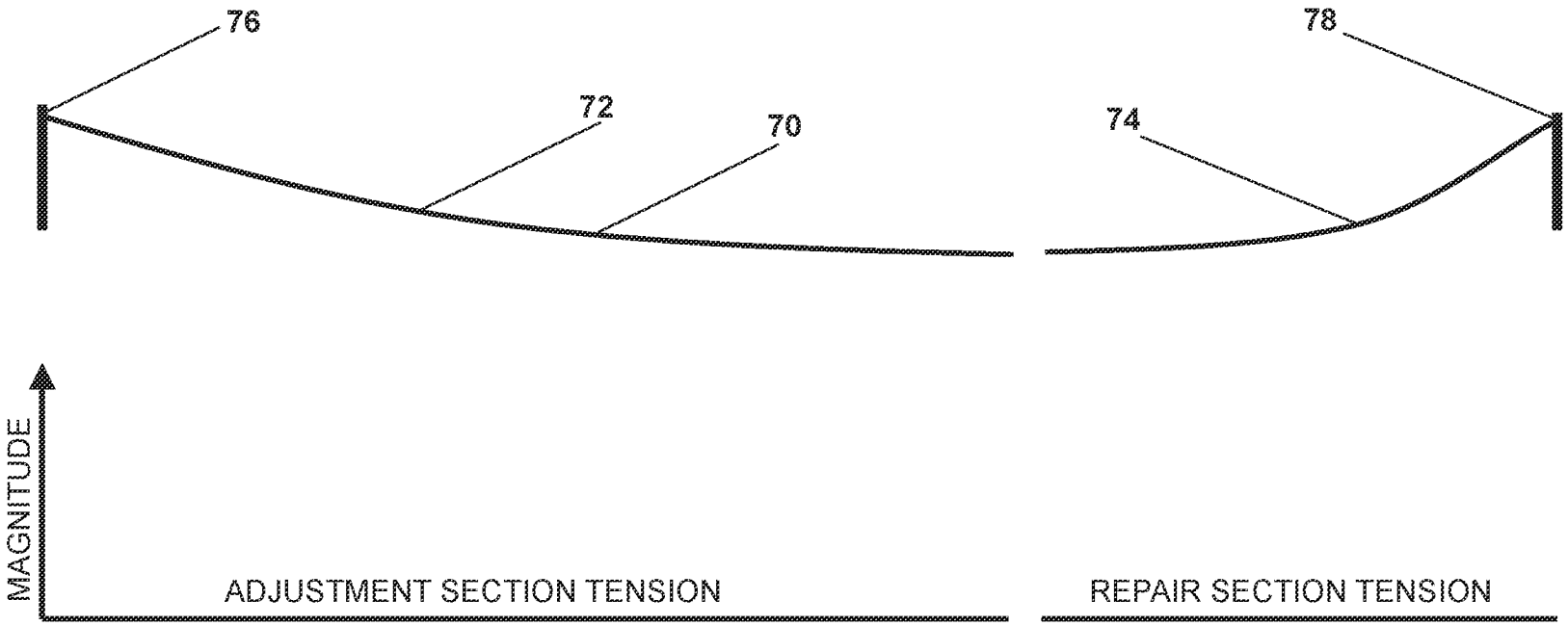
FIG. 5A is a vector diagram of the cable in need of repair while connected to a fixed end and a secured end.
Figure 5B:
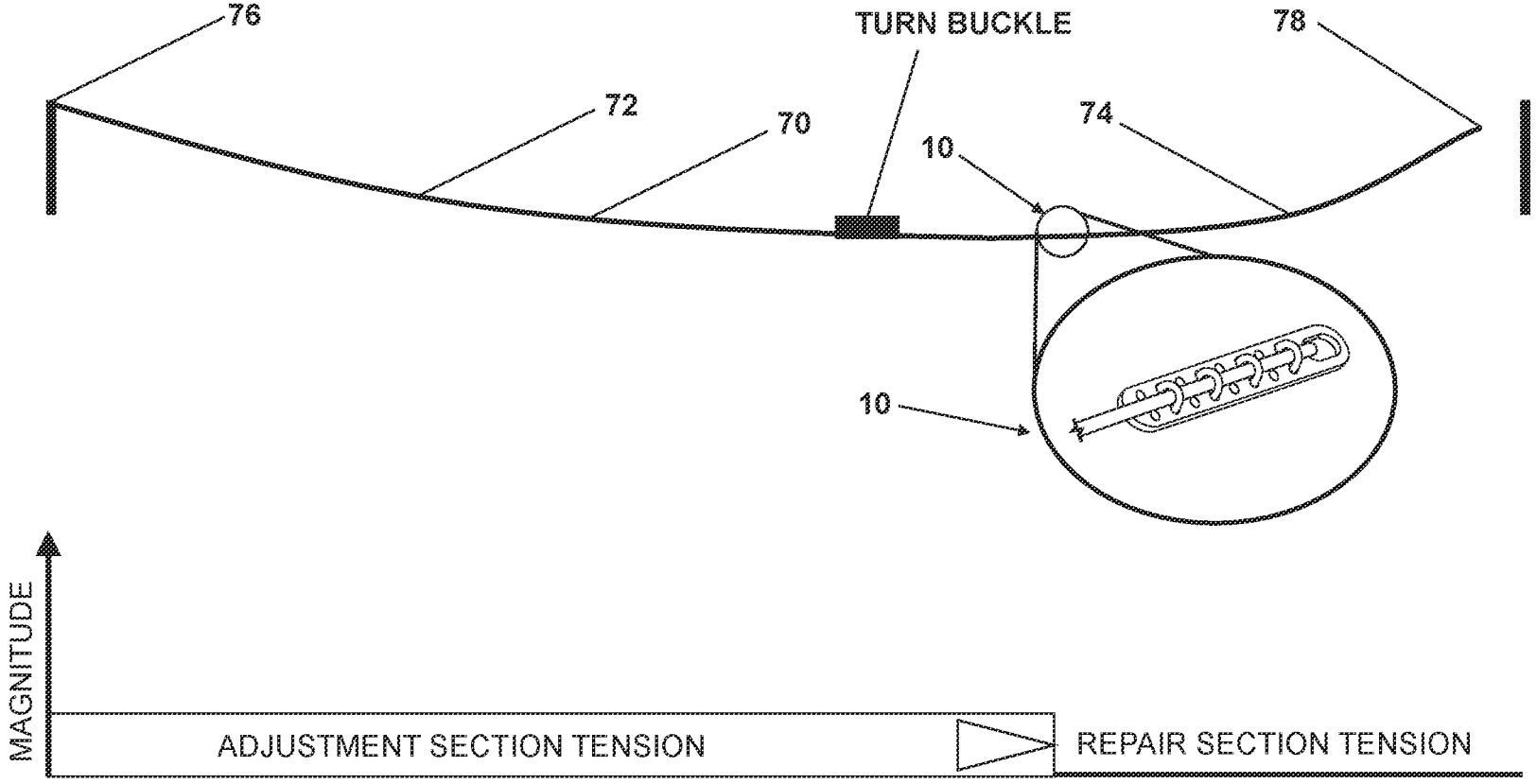
FIG. 5B is a vector diagram of the cable while connected to a fixed end and the cable tensioning assembly.
Figure 5C:
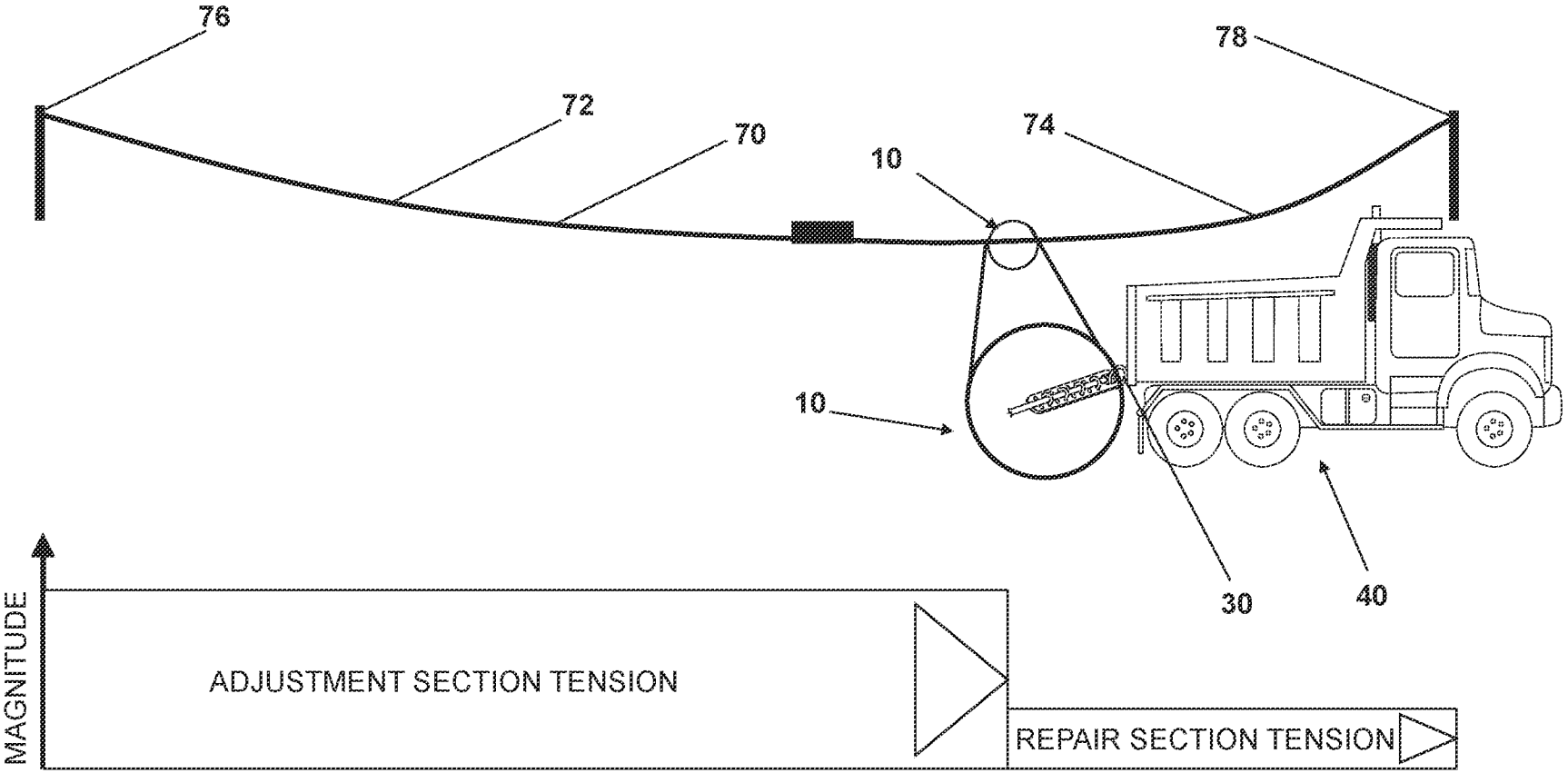
FIG. 5C is a vector diagram of the cable connected to the fixed end, the tensioning vehicle, and a secured end while a tensioning vehicle has operated to increase tension in an adjustment section.
Figure 5D:
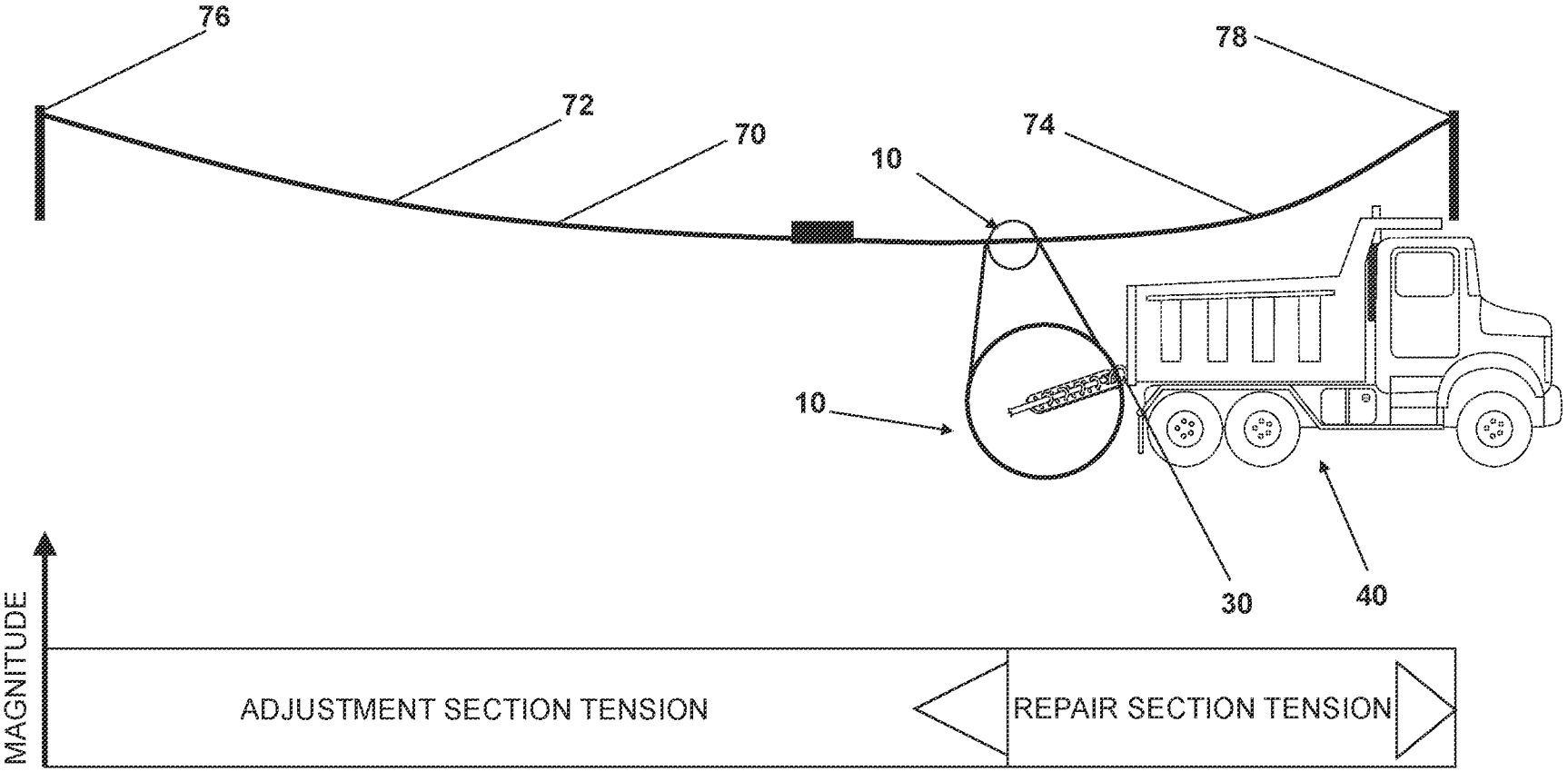
FIG. 5D is a vector diagram of the cable connected to the fixed end, the tensioning vehicle, and a secured end while a tensioning vehicle is operated to equalize tension.
Figure 5E:
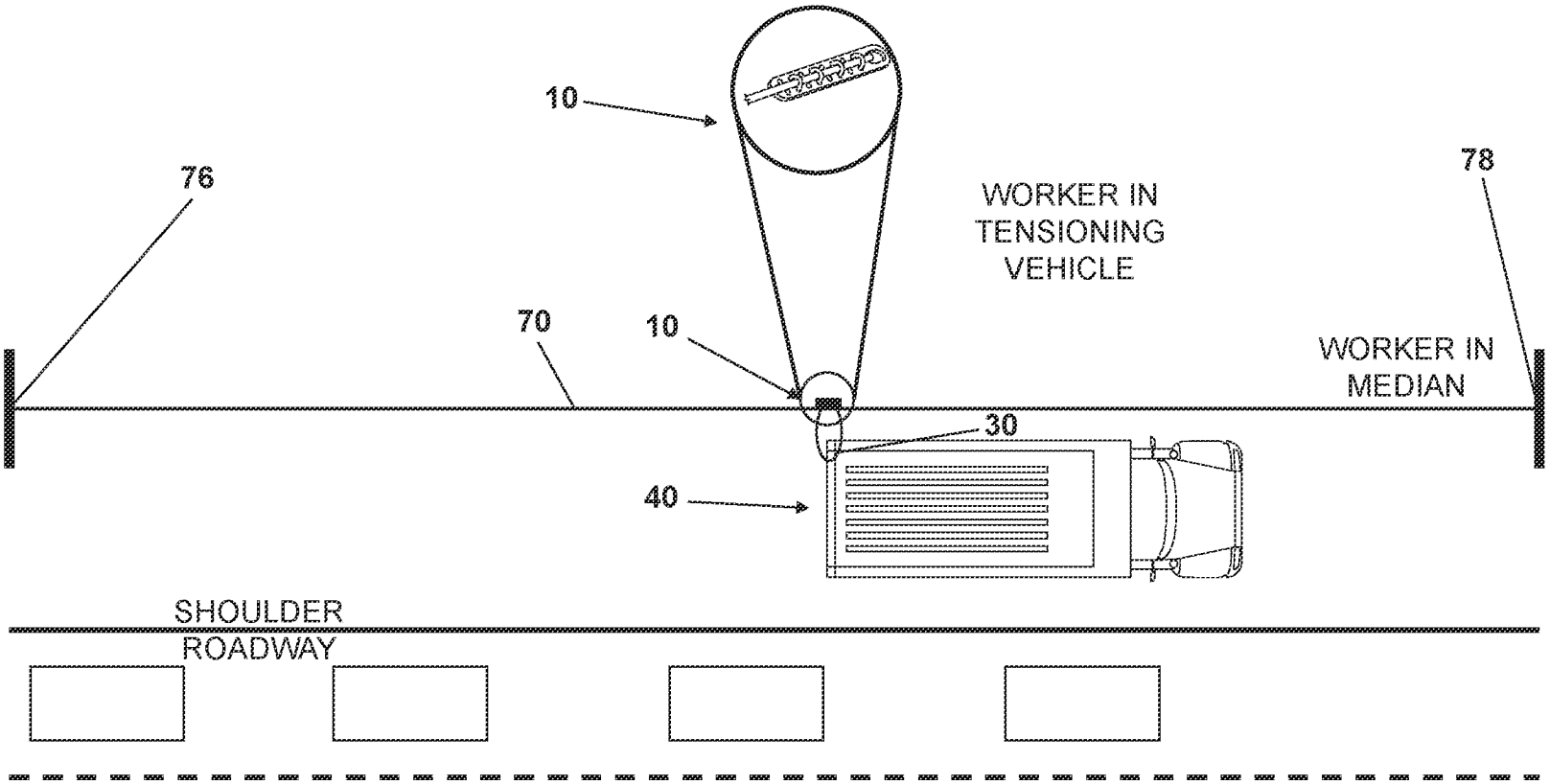
FIG. 5E is a plan view of the cable connected to the fixed end and the secured end while workers are in a median and a tensioning vehicle.

As exemplified in FIG. 5E, the use of the cable tensioning assembly 10 and the tensioning vehicle 40 provides a convenient environment for repairing and re-tensioning cables 70 along a roadway. As illustrated, an operator of the tensioning vehicle 40 is safely stationed within the cab of the tensioning vehicle 40. Additionally, after the tensioning vehicle 40 has applied the first magnitude of tension to the adjustment section 72 of the cable 70, the repair section 74 has little to no tension. This substantial lack of tension within the repair section 74 provides working crews with a convenient section of cable 70 to efficiently repair and re-attach the cable 70. Also, use of the cable tensioning assembly 10 and the tensioning vehicle 40 allows a work crew to perform the repair of the cable 70 while in a median of the roadway and well apart from the vehicles traveling on the roadway. These combination of benefits provides an efficient and convenient method for repairing, re-attaching and re-tensioning a cable 70 that has been damaged.

Referring now to FIGS. 1-10, having described various aspects of the cable tensioning assembly 10, a method 400 is disclosed for tensioning a cable 70 during the repair of a cable guardrail. According the method 400, a step 402 includes aligning the cable 70 with the channel 16 defined on the body 12 of the cable tensioning assembly 10. The method 400 also includes placing the fasteners 20 around the cable 70 (step 404). The fasteners 20 are then inserted into respective mounting apertures 22, 32 defined within the body 12 of the cable tensioning assembly 10 (step 406). As discussed herein, the fasteners 20 can includes a plurality of plates 44 that are secured to the body 12 via the fasteners 20. The fasteners 20 are then tightened and secured to the body 12 to apply a retaining friction force to the cable 70 (step 408). The cable tensioning assembly 10 is then coupled to a tensioning vehicle 40 via a tensioning receiver 14 defined on the body 12 of the cable tensioning assembly 10 (step 410). The tensioning vehicle 40 is then moved to increase a first magnitude of tension along an adjustment section 72 of the cable 70 between the fixed end 76 of the cable 70 and the portion of the cable 70 coupled with the cable tensioning assembly 10 (step 412). The free end 78 of the cable 70 is then secured to a directed location, typically the secured end 78 (step 414). This securing of the free end 78 defines a secured end 78 of the cable 70 and creates a second magnitude of tension along the repair section 74 of the cable 70 between the free end 78 of the cable 70 and the portion of the cable 70 coupled with the cable tensioning assembly 10. Once the free end 78 is redefined as the secured end 78, the tensioning vehicle 40 is moved toward the fixed end 76 to equalize the first magnitude of tension with the second magnitude of tension (step 416). The cable tensioning assembly 10 is then decoupled from the cable 70 (step 418).

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A method for tensioning a cable, the method comprising steps of:

aligning the cable with a channel defined on a cable tensioning assembly;

placing a plurality of fasteners around the cable;

inserting the plurality of fasteners into respective mounting apertures defined on the cable tensioning assembly;

tightening the plurality of fasteners on the cable tensioning assembly to apply a retaining friction force to the cable;

coupling the cable tensioning assembly to a tensioning vehicle via a tensioning receiver defined on the cable tensioning assembly;

operating the tensioning vehicle to increase a first magnitude of tension along an adjustment section of the cable between a fixed end of the cable and a portion of the cable coupled with the cable tensioning assembly;

securing a free end of the cable to a directed location to create a second magnitude of tension along a repair section of the cable between the free end of the cable and the portion of the cable coupled with the cable tensioning assembly;

operating the tensioning vehicle toward equalizing the first magnitude of tension with the second magnitude of tension; and decoupling the cable tensioning assembly from the cable.

2. The method of claim 1, wherein the coupling of the cable tensioning assembly to the tensioning vehicle is done through a coupling device connected to the tensioning receiver.

3. The method of claim 1, wherein the method includes the step of applying the first magnitude of tension to an adjustment portion resulting in little to no tension in the repair section, wherein the method includes the step of operating the tensioning vehicle toward equalizing a direction of extension of the repair section with the adjustment section.

4. The method of claim 1, wherein the method includes the step of decoupling the cable tensioning assembly from the tensioning vehicle.

5. The method of claim 1, wherein the tensioning vehicle is a dump truck.

6. The method of claim 1, wherein the first magnitude of tension is transferred from the cable to the tensioning vehicle via the tensioning receiver that is integral with the cable tensioning assembly.

7. The method of claim 1, wherein the step of tightening the plurality of fasteners on the cable tensioning assembly to apply the retaining friction force to the cable includes attaching a plurality of plates to a body of the cable tensioning assembly to define the retaining friction force.

8. The method of claim 7, wherein the step of tightening the plurality of fasteners with the cable tensioning assembly to apply the retaining friction force to the cable includes the plurality of plates and the cable tensioning assembly at least partially encircles a friction portion of the cable engaging the cable tensioning assembly.

9. The method of claim 1, wherein the repair section of the cable and the adjustment section of the cable are defined by the placement of the cable tensioning assembly with respect to the cable.

10. The method of claim 8, wherein the friction portion of the cable is within the adjustment section of the cable.

* * * * *